US010427444B2

(12) United States Patent
Honegger

(10) Patent No.: US 10,427,444 B2
(45) Date of Patent: Oct. 1, 2019

(54) METHOD FOR APPLYING AT LEAST ONE ENCLOSING ELEMENT TO A FLAT PRODUCT COMPOSITION, AND ENCLOSING ELEMENT APPLYING DEVICE FOR CARRYING OUT THE METHOD

(71) Applicant: FERAG AG, Hinwil (CH)

(72) Inventor: Werner Honegger, Baech (CH)

(73) Assignee: FERAG AG, Hinwil (CH)

( * ) Notice: Subject to any disclaimer, the term of this patent is extended or adjusted under 35 U.S.C. 154(b) by 0 days.

(21) Appl. No.: 15/368,020

(22) Filed: Dec. 2, 2016

(65) Prior Publication Data

US 2017/0080739 A1 Mar. 23, 2017

Related U.S. Application Data

(63) Continuation of application No. 13/995,871, filed as application No. PCT/EP2011/071665 on Dec. 2, 2011, now Pat. No. 9,511,613.

(30) Foreign Application Priority Data

Dec. 20, 2010 (CH) ..... 2121/10
May 16, 2011 (CH) ..... 827/11

(51) Int. Cl.
*B42C 9/00* (2006.01)
*B65C 1/04* (2006.01)
(Continued)

(52) U.S. Cl.
CPC ..... *B42C 9/0075* (2013.01); *B42C 9/0056* (2013.01); *B42F 1/00* (2013.01);
(Continued)

(58) Field of Classification Search
CPC ..... B42C 9/0056; B42C 9/0075; B42F 1/00; B65H 37/04; B65B 25/14; B65B 27/08;
(Continued)

(56) References Cited

U.S. PATENT DOCUMENTS 3,507,089 A 4/1970 Mizelle et al.
3,996,728 A 12/1976 Gentili
(Continued)

FOREIGN PATENT DOCUMENTS

AU 2005100618 A4 8/2005
CH 461248 8/1968
(Continued)

OTHER PUBLICATIONS

Machine translation of DE 542606 date unknown.*

*Primary Examiner* — John L Goff, II
(74) *Attorney, Agent, or Firm* — Pauley Erickson & Kottis

(57) ABSTRACT

A method for applying at least one enclosing element to a flat product composition wherein the enclosing element is subsequently applied around a selected edge of the product composition in a perpendicular manner with respect to said edge so as to rest against the product composition. A reliable operation that is independent of the type of enclosing element is achieved in that the selected edge of the product composition is moved forward along a transporting path, the enclosing element is held ready at a specified point of the transporting path so as to intersect the transporting path, the selected edge of the product composition is moved past the specified point, and at the same time the selected edge drives the enclosing element that is held ready.

13 Claims, 6 Drawing Sheets

(51) Int. Cl.
*B65H 37/04* (2006.01)
*B42F 1/00* (2006.01)

(52) U.S. Cl.
CPC ..... *B65C 1/042* (2013.01); *B65H 37/04* (2013.01); *B65H 2301/422* (2013.01); *B65H 2301/4382* (2013.01); *B65H 2301/4474* (2013.01); *B65H 2701/182* (2013.01); *B65H 2701/1829* (2013.01); *B65H 2701/1932* (2013.01); *Y10T 156/1028* (2015.01); *Y10T 156/1089* (2015.01)

(58) Field of Classification Search
CPC ..... B42B 5/04; B65C 1/042; B65C 1/045; Y10T 156/1028; Y10T 156/1034; Y10T 156/1051; Y10T 156/1089
See application file for complete search history.

(56) References Cited

U.S. PATENT DOCUMENTS

| | | | | |
|---|---|---|---|---|
| 4,160,687 | A | | 7/1979 | Spear |
| 4,596,620 | A | | 6/1986 | Karolyi |
| 5,088,712 | A | | 2/1992 | Luperti |
| 5,096,176 | A | | 3/1992 | Golicz et al. |
| 5,376,217 | A | * | 12/1994 | Janssen, Jr. ..... B32B 38/1833 156/361 |
| 5,632,476 | A | | 5/1997 | Stauber |
| 5,980,676 | A | | 11/1999 | Meetze |
| 6,082,727 | A | | 7/2000 | Thompson |
| 6,464,819 | B1 | | 10/2002 | Sette et al. |
| 6,978,990 | B2 | | 12/2005 | Silverbrook |
| 6,998,742 | B2 | | 2/2006 | Yamaguchi et al. |
| 7,128,118 | B2 | | 10/2006 | Kramer et al. |
| 7,611,135 | B2 | | 11/2009 | Kaya |
| 2010/0194023 | A1 | | 8/2010 | Ozawa et al. |
| 2013/0280014 | A1 | | 10/2013 | Honegger |

FOREIGN PATENT DOCUMENTS

| | | | | | |
|---|---|---|---|---|---|
| DE | 542606 | C | * | 1/1932 | ..... B65C 1/042 |
| DE | 1 103 228 | | | 3/1961 | |
| DE | 87 01 920 | U1 | | 6/1988 | |
| DE | 692 14 614 | T2 | | 3/1997 | |
| DE | 10 2004 045 603 | A1 | | 4/2006 | |
| EP | 0 266 454 | A1 | | 5/1988 | |
| EP | 0 493 109 | A1 | | 7/1992 | |
| EP | 0 666 186 | A1 | | 8/1995 | |
| EP | 1 409 347 | B1 | | 11/2004 | |
| EP | 1 516 839 | A1 | | 3/2005 | |
| EP | 1 557 388 | A1 | | 7/2005 | |
| EP | 2 174 795 | A2 | | 4/2010 | |
| JP | 2003/300501 | A | | 10/2003 | |
| WO | WO 97/49563 | A1 | | 12/1997 | |
| WO | WO 2008/074325 | A1 | | 6/2008 | |

* cited by examiner

METHOD FOR APPLYING AT LEAST ONE ENCLOSING ELEMENT TO A FLAT PRODUCT COMPOSITION, AND ENCLOSING ELEMENT APPLYING DEVICE FOR CARRYING OUT THE METHOD

CROSS REFERENCE TO RELATED APPLICATION

This application is a continuation of U.S. patent application Ser. No. 13/995,871, filed on 19 Jun. 2013, now U.S. Pat. No. 9,511,613, which is a U.S. National Phase Application of PCT/EP2011/071665, filed 20 Dec. 2010, which claims the benefit of Swiss Patent Application 02121/10, filed 20 Dec. 2010 and Swiss Patent Application 00827/11, filed 16 May 2011. The co-pending parent application is hereby incorporated by reference herein in its entirety and is made a part hereof, including but not limited to those portions which specifically appear hereinafter.

BACKGROUND OF THE INVENTION

Field of the Invention

The present invention relates to the field of handling sheet-like product assortments, as is performed, for example, in the further processing of printed products. It relates to a method for applying at least one enclosing element to a sheet-like product assortment. It also relates to an enclosing element application device for performing the method.

Discussion of Related Art

Today there is an increasing quantity of advertising material, in the form of sheet-like upstream products, such as brochures, flyers, catalogs, leaflets, mail circulars but also product samples, CDs, etc., that is distributed directly by specialized service providers. Advertising material from different providers are here often combined and distributed together in order to keep distribution costs low. The advertising material or upstream products that are distributed together then form a stack of individual copies lying one on top of the other which then needs to be assorted by hand, for example, by the distributor in each case at the point of supply. However, this manner of assortment is time-consuming and liable to error so that certain pieces of advertising material may either appear several times in the stacks that have been formed or be missing altogether.

Stacks are here understood in principle to be assortments of sheet-like upstream products that lie one on top of the other and are held together by gravity. If the upstream products are aligned in a different spatial orientation, for example vertically with one lying on top of the other, they are here also referred to as a collection. The invention relates essentially to such different manners of assorting the upstream products, which will be referred to below as product assortments.

When stack-like product assortments or sheet-like products are processed, as occurs for example when printing newspapers, it is often desirable to hold such product assortments together by applying strips, or to differentiate them from other product assortments.

If a large number of product assortments need to be processed per unit time, i.e. need to be provided with such strips, in this way, the corresponding method needs to he simple to perform, allow a high processing speed, and moreover be able to operate in an operationally reliable manner.

A method and a device for producing multi-part units of printed products are known from EP 0 666 186 A1, in which inserts are arranged inside a folded newspaper that serves as the outer part of the product unit. A piece of adhesive tape joins the two halves of the newspaper together in order to stop the inserts from slipping and prevent them from falling out of the newspaper. The pieces of adhesive tape are here cut off from an adhesive tape before being applied and the individual pieces are then transported and deposited by means of a separate transportation apparatus to the newspapers that are situated in a drum with pocket-like holding parts and are moved on a circular track. This manner of application requires highly complex machinery.

U.S. Pat. No. 5,096,176 and EP 0 493 109 A1 describe a device and a method by means of which one edge of a stack of sheets of paper is provided with a non-adhesive paper strip in such a way that multiple stacks are reliably separated from each other. To do this, a strip of paper is fed from a roller so that it crosses into the transportation path of the stack, so that the transported stack carries along the strip of paper and at the same time leads it past a downstream blade in such a way that a piece of strip is cut off from the strip of paper. The stack with the cut-off piece of strip is then guided between two belts that are circulating in parallel, wherein the piece of strip is folded around the front edge of the stack. Owing to the distance between the position of the crosswise strip and the downstream belts, it is not possible to apply pieces of adhesive tape and this should be expressly avoided.

DE 69214614 T2 discloses a method and a device for temporarily joining together multiple sheets of an information recording medium. To do this, segments of adhesive joining tape are provided at opposite ends and are applied around the edge of a compiled set stack by means of a displaceable application means. Complicated, mechanically movable machinery is used for cutting and applying the segments which has a complex structure, is slow when in use, and is prone to operational faults owing to its complexity.

A method for wrapping a stack of sheets, brochures or the like is known from WO 2008/074325 A1 in which the stacks are transported, spaced apart, one behind the other on a transportation path. A wrapping sheet is drawn off by means of a specialized swivel wheel from a sheet supply that is held ready for use, is positioned vertically in a gap between two successive stacks, and is then folded around the stack that is moved past by means of the swivel wheel. The complicated movement of the swivel wheel militates against a high stack processing speed.

EP 1 409 347 B1 discloses a method for enveloping printed matter by arranging a film around the printed matter. The film is here arranged on a first conveying device. The printed matter is then arranged partially on top of the film so that a part of the film that is at the front in the direction in which it is conveyed is not covered by the printed matter. A rising stream of air is then provided, as a result of which the front part of the film is blown upward into a vertical position. The printed matter with the film is then conveyed onward beneath an upper strap, as a result of which the film is folded back along the top of the printed matter. The problem here is that the film must first be laid on the transportation mechanism and positioned there, and the printed matter must then correspondingly be deposited on the film and similarly positioned. This requires complex machinery and restricts the processing speed.

U.S. Pat. No. 6,464,819 describes a method and a device for sealing folded material that has a folded end and an open end and is intended to be sealed at the open end so that it can be mailed. The method is thus similar to scaling an open envelope that has already been joined together at the folded end. Product assortments within the sense of the present application, in which sheet-like products lie loosely on top of one another, are not the subject of this document.

U.S. Pat. No. 3,507,089 A relates to a bundling device in which multiple cigarette packets arranged next to one another and on top of one another are combined in a complicated method to form a stick and are completely enclosed and packaged with a wrapping material. The packaging material is thus supplied as a broad web perpendicular to the transportation path, a piece is cut off by a rotating blade and the piece is carried along by the stick.

A similar device for completely wrapping stacks of paper sheets is known from U.S. Pat. No. 3,996,728.

SUMMARY OF THE INVENTION

The object of the invention is therefore to provide a method and a device for applying enclosing elements to product assortments, which avoid the disadvantages of known solutions, work quickly and reliably, and are suitable equally for applying adhesive and non-adhesive enclosing elements.

This and other objects are achieved by the features of the claimed invention.

The method according to the invention for applying at least one enclosing element to a sheet-like product assortment comprising multiple products, in particular printed products, is based on a method in which an enclosing element of predetermined length is provided and then applied, perpendicular to a selected edge of the product assortment, around the edge so that it fits closely against the product assortment. It is characterized in that the product assortment is moved with the selected edge at the front along a transportation path, in particular with the surface essentially parallel to the transportation path, in that the enclosing element is held ready for use at a predetermined point of the transportation path so that it crosses the transportation path, and in that the product assortment is moved past the predetermined point with the selected edge at the front, and thus carries along the enclosing element held ready for use with the selected edge.

An embodiment of the method according to the invention is characterized in that the enclosing element is held ready for use at a predetermined point of the transportation path, supported in the direction of transportation. Another embodiment of the method according to the invention is characterized in that the enclosing element takes the form of a piece of strip, and in that the piece of strip is separated from a provided strip, in particular cut off from it, when it is carried along by the product assortment.

Another embodiment of the method is characterized in that, in order to cut off the piece of strip, the provided strip is pressed against a blade by the product assortment as it is moved past the predetermined point.

Another embodiment of the method according to the invention is characterized in that the strip is advanced toward the transportation path from above or below, counter to the transportation direction, and in that the blade is arranged at a distance from the transportation path, above or below it. However, a different direction of transportation of the strip, in particular an opposing one, is also possible within the scope of the invention.

The strip is here preferably advanced continuously, in particular at a constant speed.

Another embodiment of the method according to the invention is characterized in that, in order to separate or cut off the piece of strip, the provided strip is brought into a position in which it crosses the transportation path by a handling means.

An appropriately directed jet of air from an air nozzle is used in particular as a handling means. Of course, a different gas instead of air can be directed from the nozzle onto the piece of strip.

A further embodiment of the method according to the invention is characterized in that the enclosing element takes the form of an individual element, in particular a self-adhesive label, and in that the individual element or label is removed or peeled off from a carrier tape in order to be carried along by the product assortment. Here too can an appropriately directed jet of air from an air nozzle be used as a handling means.

Another embodiment of the method according to the invention is characterized in that the product assortment with the carried-along enclosing element or piece of strip or individual element is moved through a pressure means that presses those regions of the enclosing element or piece of strip or individual element that are situated outside the edge against the side faces of the product assortment that are situated parallel to the transportation path.

A further embodiment of the method according to the invention is characterized in that the pressure means applies the enclosing element or the piece of strip or the individual element to the product assortment backward, simultaneously counter to the direction of movement of the product assortment, by being pressed against it.

An upper pressure brush that extends parallel to the transportation path and a lower pressure brush that extends parallel to the transportation path are used in particular as the pressure means. The pressure brushes are in particular stationary.

The enclosing element or the strip or piece of strip or the individual element is preferably provided on at least one side with adhesive means, in particular an adhesive layer, and the enclosing element or the piece of strip is held ready for use with the side provided with the adhesive means or the adhesive layer facing the oncoming product assortment.

A further embodiment of the method according to the invention is characterized in that an enclosing element or strip and piece of strip or individual element is/are used that is/are made from paper, a plastic film or metal, in particular also individual sheets of paper.

The enclosing element or strip or piece of strip or the individual element can be provided on the long sides with weakening means that make it easier to split or rip.

The enclosing element application device according to the invention comprises a transportation device for transporting the sheet-like product assortments which defines a transportation path running through the application unit, wherein the application unit is equipped with means for holding an enclosing element to be applied ready for use at a predetermined point of the transportation path in a position where it crosses the transportation path. It is characterized in that stop means are provided, spaced apart on both sides of the transportation path, against which the enclosing element to be applied lies, across the transportation path, and is supported in the direction of transportation in such a way that the product assortments transported on the transportation path can be moved between the stop means, carrying the enclosing elements along with them.

An embodiment of the enclosing element application device according to the invention is characterized in that the enclosing elements take the form of pieces of strip, and in that the means for holding a piece of strip to be applied ready for use comprise first means for holding a strip ready for use and second means for cutting off the piece of strip to be applied from the provided strip.

In particular, the first means comprise a feed unit with at least one driven roller against which the strip lies.

Another embodiment of the enclosing element application device is characterized in that the second means comprise a blade that is situated at a distance from and parallel to the transportation path and has its cutting edge pointing in the opposite direction to the direction of transportation.

Another embodiment of the enclosing element application device is characterized in that the enclosing elements take the form of individual elements, in particular self-adhesive labels, and in that the means for holding an individual element to be applied ready for use comprise first means for advancing a carrier tape provided with individual elements, and second means for removing or peeling off the individual element to be applied from the carrier tape.

Another embodiment of the enclosing element application device is characterized in that an air nozzle is provided for aligning and applying the piece of strip or individual element against the stop means. However, a gas nozzle can also generally be provided instead of the air nozzle.

Another embodiment of the enclosing element application device is characterized in that pressure means, which press the carried-along piece of strip or the carried-along individual element against the side faces of the product assortment that are situated parallel to the transportation path, are arranged behind the stop means in the direction of transportation.

The pressure means comprise in particular an upper pressure brush extending parallel to the transportation path, and a lower pressure brush extending parallel to the transportation path.

Another embodiment is characterized in that the upper pressure brush has long, soft bristles that are bent when a product assortment passes through in the direction of movement and cling to the product assortment as it passes through, and in that the lower pressure brush has short, hard bristles, the ends of which form a (stationary) portion of the continuous transportation path.

A method for packaging a stack of single- or multi-layer upstream products lying loosely one on top of the other or a collection of such products lying loosely against one another, in particular printed products of the same or different size with two upstream products situated on the outside, in which method the stack or the collection is held together so that it is easier to handle later, has already been described in the first application CH 02121/10 filed in Switzerland on 20 Dec. 2011, the priority of which is claimed for the present application and the disclosed content of which is to be explicitly part of the disclosure of the present application.

BRIEF DESCRIPTION OF THE DRAWINGS

The invention is explained in detail below with reference to the exemplary embodiments in conjunction with the drawings, in which.

DETAILED DESCRIPTION OF THE INVENTION

FIG. 1 shows several schematic part figures (FIGS. 1A-D) of different steps in a method for applying an enclosing element in the form of a piece of strip to a sheet-like product assortment comprising multiple products according to an exemplary embodiment of the invention. An enclosing element is here generally understood to mean an element that can enclose the product assortment from one side.

FIG. 1 shows an exemplary embodiment of an enclosing element application device in the form of a strip application device 10 that comprises a transportation device or transportation path 12 that runs, for example, horizontally and on which product assortments 11*a*, 11*b* lie and are transported in sequence through an application unit 30 indicated by a square in dashed lines. In the application unit 30, the product assortments 11*a*, 11*b* delivered on the transportation path 12 are provided one after the other at their front edge 31 with a piece of strip 14*a* that is laid around the edge 31, perpendicular to the edge 31, and lies, in particular adhesively, against the upper and lower side face of the product assortments 11*a*, 11*b* (FIG. 1D). Consequently, products situated inside the product assortments 11*a*, 11*b* also adhere with one edge to the pieces of strip and are thus fixed inside the product assortment.

The application unit 30 contains two pressure brushes 17*a* and 17*b* that are arranged essentially parallel to each other and parallel to the transportation path 12, one above the other at a distance such that, for example, the ends of their bristles meet at the level of the transportation path 12, and that a product assortment 11*a,b* transported on the transportation path 12 through the application unit 30 can be moved through between the upper pressure brush 17*a* and the lower pressure brush 17*b*.

In the exemplary embodiment in FIG. 1, the upper pressure brush 17*a* has long, soft bristles that are oriented perpendicular to the direction of transportation when not in operation and bend in the direction of transportation when a product assortment 11*a,b* moves through, and lie against or cling to the product assortment 11*a,b,* and thus can compensate for different thicknesses of the product assortments 11*a,b* without the need to make any other adjustments to the system. In the example, the lower pressure brush 17*b* has short, hard bristles that are inclined forward slightly in the direction of transportation, carry the product assortment 11*a,b* as it is moved past without any appreciable deformation, and so form a perfectly level portion of the transportation path 12.

In this way, the pressure brushes 17*a,b* ensure that the piece of strip 14*a* to be applied lies closely against the product assortment 11*a,b* and at the same time is applied tightly to the rear of the product assortment 11*a,b*.

Figure 1A:
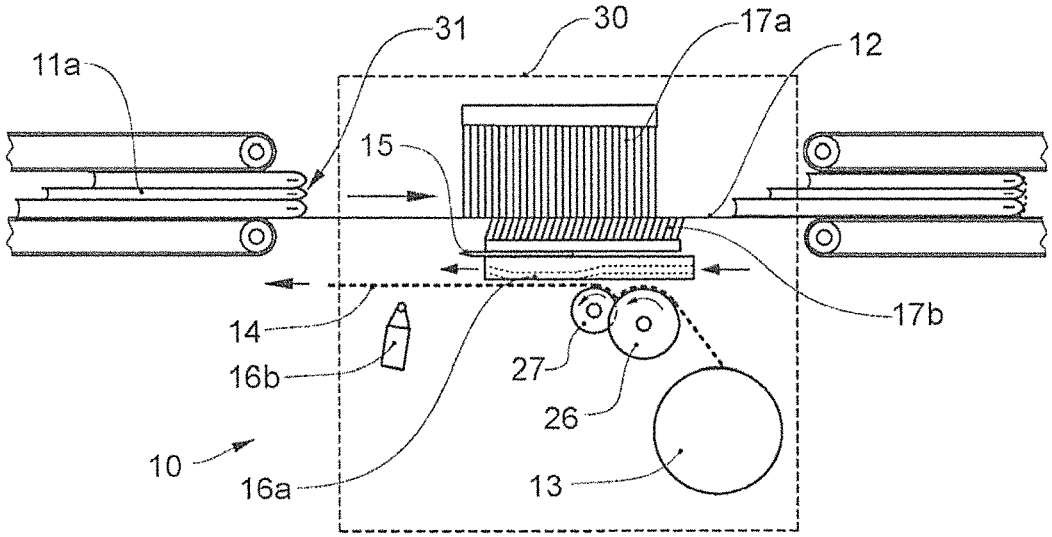
FIG. 1 shows several schematic part figures (FIGS. 1A-D) of different steps in a method for applying a piece of strip to a sheet-like product assortment according to an exemplary embodiment of the invention.
Figure 1B:
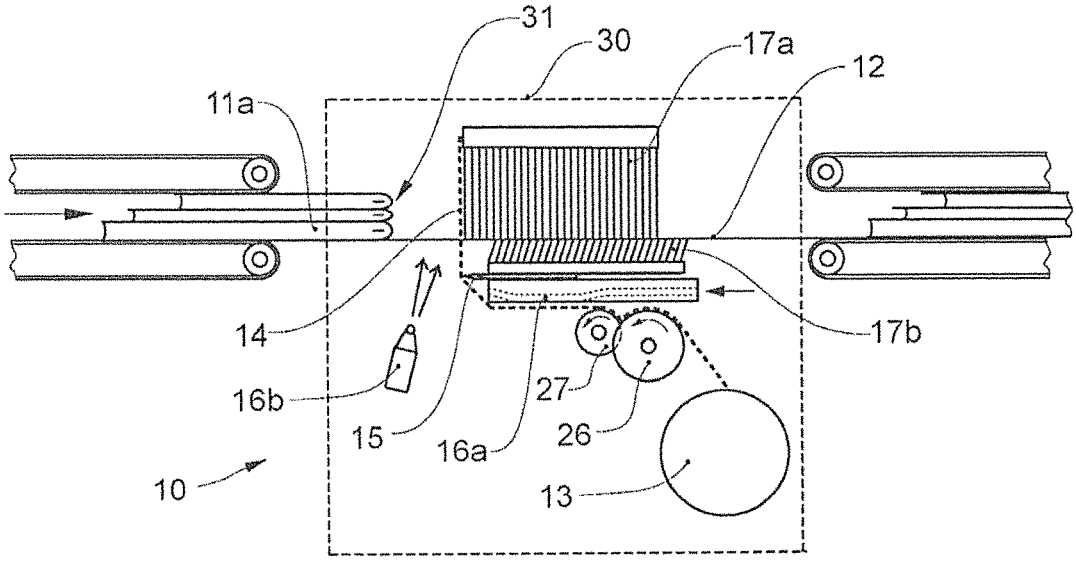

In the example, the upper pressure brush 17*a* has another important function too: its edge that is to the rear in the direction of transportation serves, together with a blade 15 arranged underneath with a cutting edge at the same height vertically, as a stop means for the piece of strip 14*a* to be applied. As can be seen in FIG. 1B, the strip 14 from which the piece of strip 14*a* is cut off assumes a position perpendicular to the transportation path 12 by lying against the front edge of the upper pressure brush 17*a* and the cutting edge of the blade 15. In contrast, the lower pressure brush 17*b* is set back somewhat in the direction of transportation and does not perform the role of a stop means.

Figure 1C:
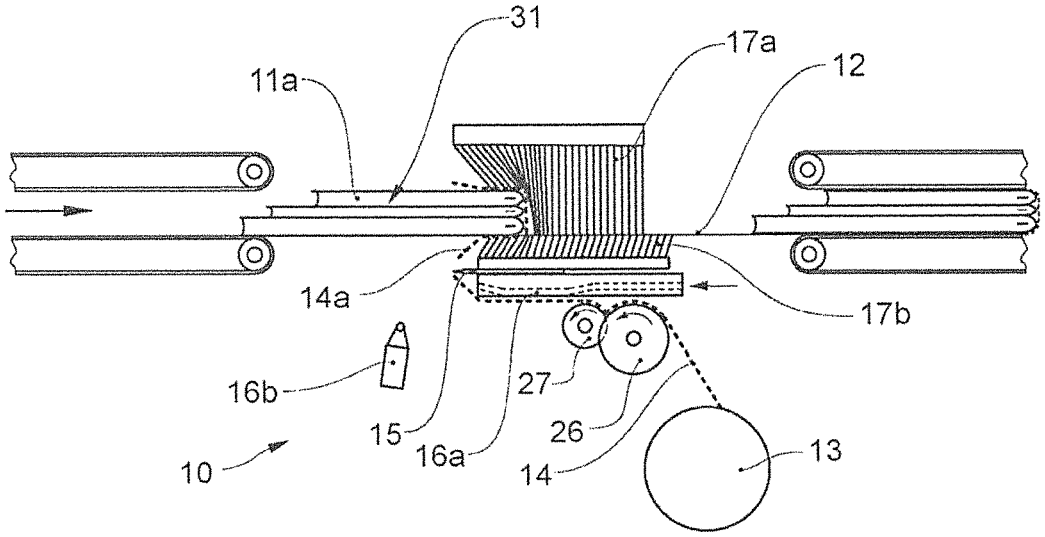
Figure 1D:
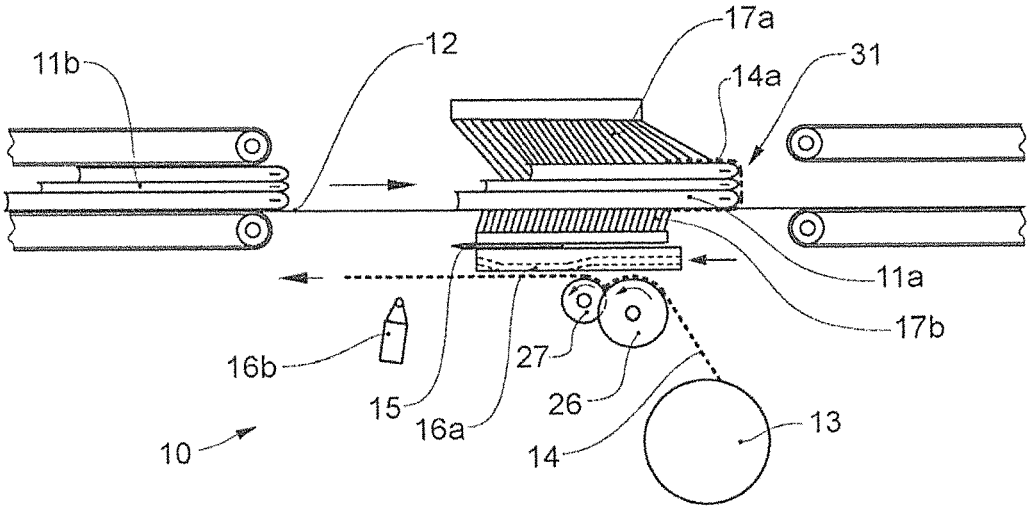

This dual function of the upper pressure brush 17*a* is advantageous for the operational safety of the device. As soon as a product assortment 11*a* with its front edge 31 reaches and carries along the strip 14 lying against the upper pressure brush 17*a* and the blade 15 and crossing the transportation path 12, said strip is pressed against the top of the product assortment 11*a* and is applied tightly backward, counter to the direction of transportation (FIG. 1C). In this way, on the one hand the strip 14 or piece of strip 14*a* is applied reliably and with no creases to the product assortment 11*a*. This is particularly important when a strip provided with an adhesive layer, or an adhesive tape, is applied. On the other hand, the strip 14 is tensioned, which makes it easier to cut off the piece of strip 14*a* from the strip 14 at the blade 15.

In order to advance the strip 14 and make it lie vertically against the upper pressure brush 17*a* and the blade 15, a feed unit 13 is provided that has been symbolized in a simplified fashion by a circle in FIG. 1. The feed unit 13 feeds the strip 14, which is for example unreeled from a supply roller (not shown), via two driven rollers rotating in the same direction (26, 27 in FIG. 2) beneath the blade 15, continuously and at a constant speed, counter to the direction of transportation, parallel to the transportation path 12 (FIG. 1A). The feed unit 13 is here designed such that the fed strip 14 is slightly curved transversely, which stabilizes the (freely) guided fed strip 14 in the direction of feed. The feeding speed here is matched to the speed of transportation of the product assortments 11*a,b* on the transportation path 12 in such a way that the feed unit 13 that feeds the strip 14 at a speed of feeding can always introduce a piece of strip 14*a* of predetermined length precisely into each gap between two successive product assortments 11*a,b*. The speed of feeding is here generally lower than the speed of transportation. In particular, the speed of feeding is continuous and preferably constant.

In order to make the strip 14 fed beneath the blade 15 from below nonparallel to the direction of transportation lie against the blade edge and the upper pressure brush 17*a*, at least one gas or air nozzle 16*b* is provided that generates an air jet that is directed obliquely upward in the direction of transportation (FIG. 1B), bends the strip 14 around the cutting edge of the blade 15, and lies against the front side of the upper pressure brush 17*a*. The change in direction of the strip 14 caused by the air jet is influenced by the blade 15 that, as already mentioned above, is arranged essentially parallel to the pressure brushes 17*a,b* below the lower pressure brush 17*b* in such a way that a piece of strip 14*a* is cut off from the strip 14 when the strip 14 is pulled between the pressure brushes 17*a,b* (FIG. 1B ->FIG. 1C) by the product assortment 11*a*. While according to FIG. 1D the product assortment 11*a* is transported through between the brushes 17*a,b* with the piece of strip 14*a* lying around the front edge, the feed unit 13 feeds the strip 14 continuously counter to the direction of transportation until the next piece of strip is available again in the next gap between the product assortments 11*a* and 11*b*.

To assist the feeding of the strip 14 that is effected nonparallel to the direction of transportation, a pneumatic working guide device 16*a* is arranged beneath the blade 15, and a reduced pressure is generated on the underside of said device that is oriented parallel to the direction of transportation, said reduced pressure pulling the fed strip 14 toward the underside. The reduced pressure can be generated, for example, by an internal pressure duct with a Venturi nozzle or the like.

Figure 2:
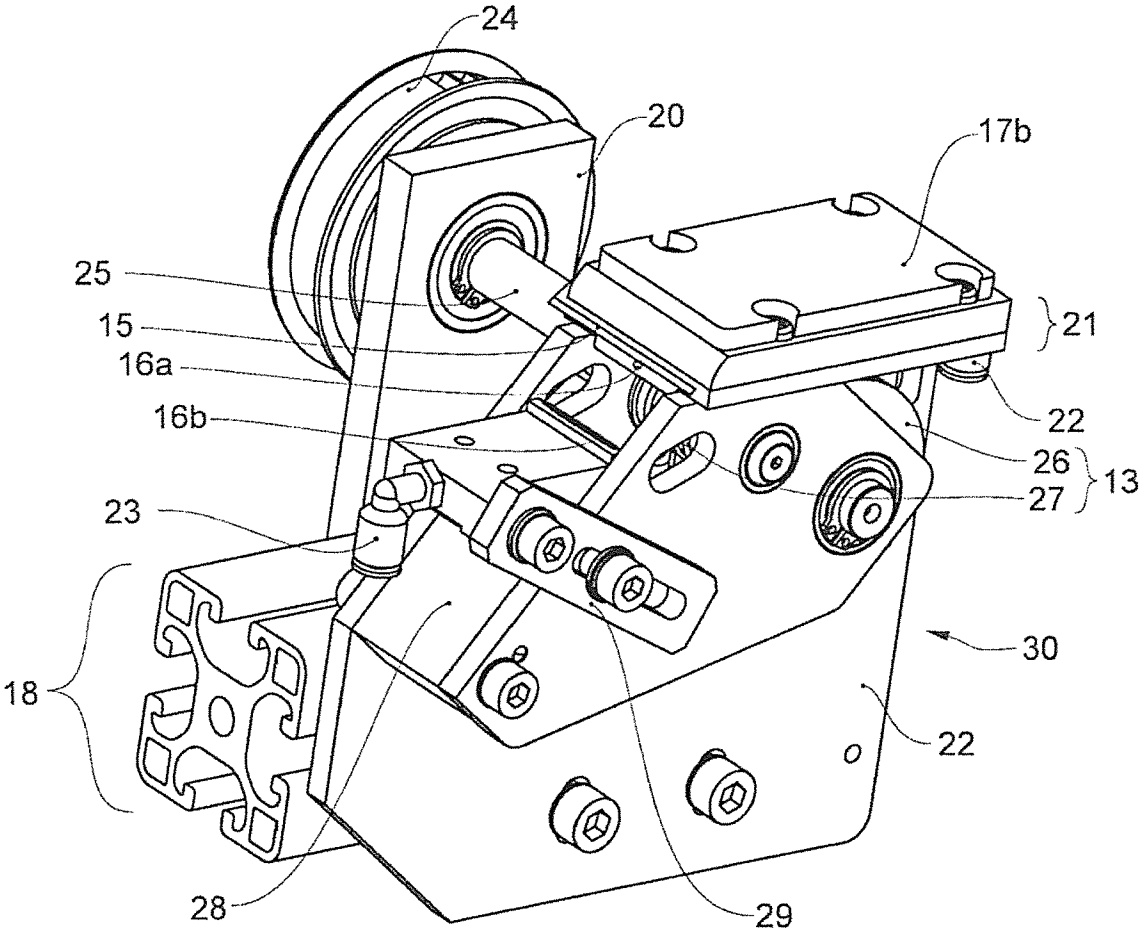
FIG. 2 shows a perspective side view of an application unit, suitable for the method according to the invention, according to an exemplary embodiment of the invention.
Figure 3:
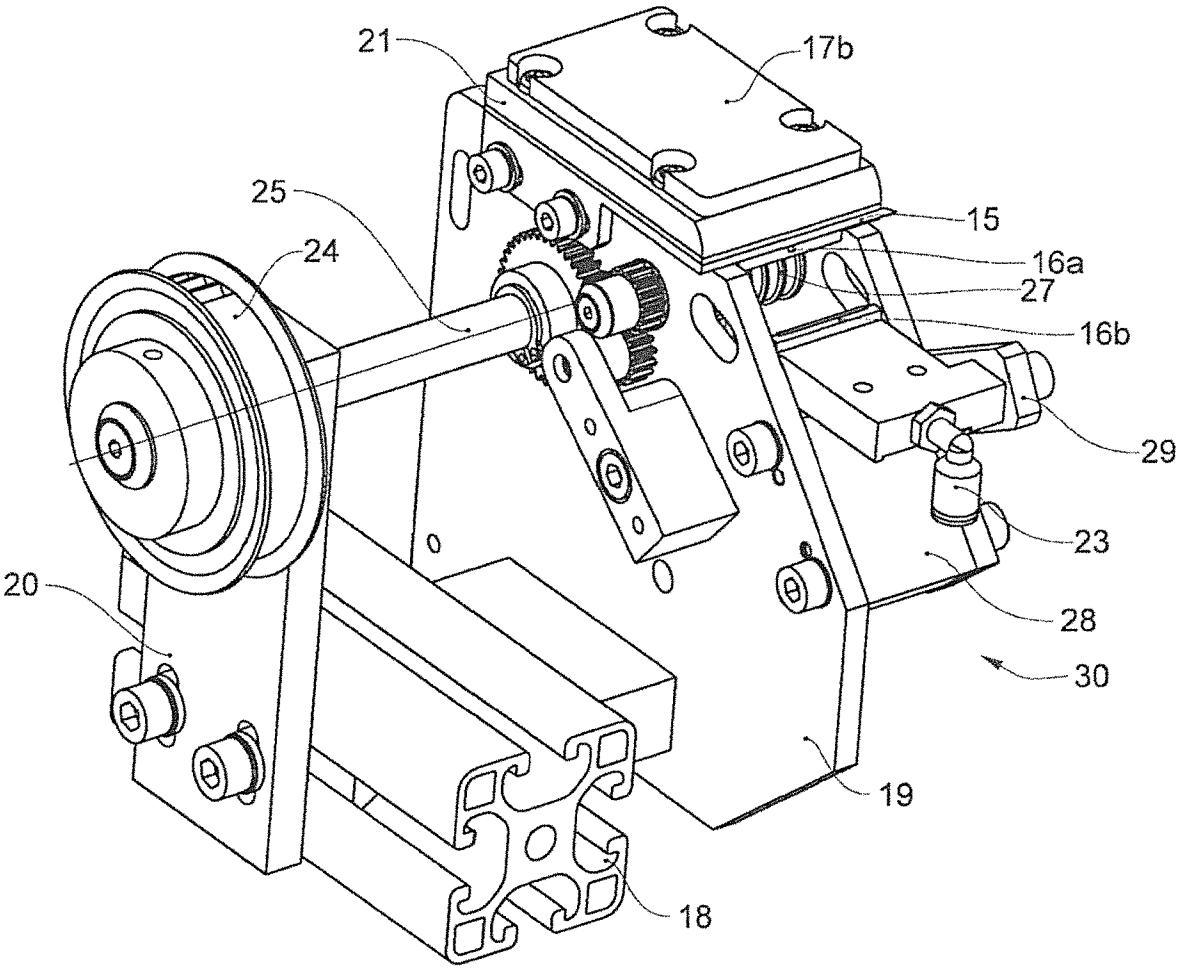
FIG. 3 shows the application unit from FIG. 2, viewed from the side.

An application unit 30, in which only the upper pressure brush 17*a* has been omitted from FIG. 1 to simplify matters, is shown by way of example in FIGS. 2 and 3 in a perspective side view from different viewpoints. The application unit 30 shown in FIGS. 2 and 3 is mounted on a central support profile 18. Two parallel mounting plates 19 and 20 are fastened to opposite sides of the support profile 18. A driveshaft 25 is rotatably mounted in the two mounting plates 19, 20 and carries at one end, on the outside of the mounting plate 20, a drive wheel 24 that is fixed in rotation and is designed to engage with a driving toothed belt. At the other end, on the outside of the mounting plate 19, the driveshaft carries a transportation roller 26 that forms the feed unit 13 in combination with a counter-roller 27 that acts as a peel-off roller. The directions of rotation of the transportation roller 26 and counter-roller 27 are synchronized with each other via a gear drive in such a way that they have the same direction of rotation (see rotation arrows in FIG. 1). The two rollers 26 and 27 are each constructed from spaced-apart disks with a knurled circumferential surface and a diameter and position along the shaft that are selected such that the two rollers engage with each other reciprocally by way of their disks. The counter-roller 27 thus peels off the strip lying on the transportation roller 26 from this roller. The structure of individual disks and the knurling of the outer surfaces prevents the risk of sticking when the strip 14 is provided on the side facing the rollers 26, 27 with an adhesive layer.

A two-part blade holder 21, in which a blade 15 is clamped and which carries the lower pressure brush 17*b* (shown in simplified fashion as a block) on its top, is fastened to the outside of the mounting plate 19. On its side, the blade holder 21 has a first pressurized air connector 22 via which a canal that is integrated in the lower part and generates a reduced pressure on the underside of the blade holder 21 can be supplied with pressurized air. A second pressurized air connector 23 conveys pressurized air to the air nozzle 16*b* where it emerges through a nozzle orifice in order to make the strip 14 lie against the upper pressure brush 17*a* and the blade 15. The air nozzle 16*b* is fastened to the outside of the mounting plate 19 by means of a nozzle support 28. An adjusting device 29 between the air nozzle 16 and the nozzle support 28 allows the height and direction of the air nozzle 16*b* to be set. The cutting edge of the blade 15 is shown in FIGS. 2 and 3 as a straight edge but it can also be curved in a crescent shape to make the cutting off easier.

Figure 4:
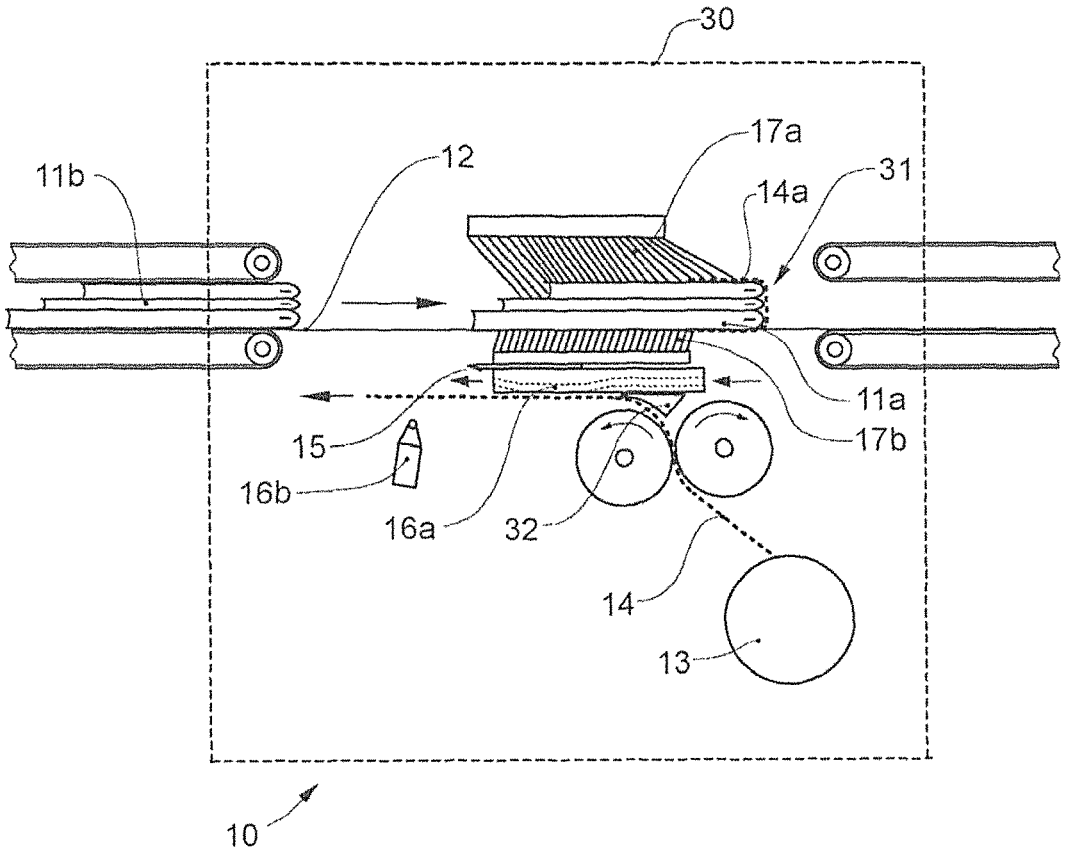
FIG. 4 shows a view, similar to FIG. 1, of an application unit in which the strip is fed between two rollers rotating in opposite directions, counter to the direction of transportation.

Instead of the two rollers 26 and 27 rotating in the same direction according to FIGS. 1 and 2, over which the strip 14 runs, according to FIG. 4 a pair of rollers rotating in opposite directions and between which the strip 14 is transported can also be provided. A deflecting wedge 32, which deflects the strip 14 emerging between the rollers toward the guide device 16*a*, is then arranged on the underside of the blade holder 21. It is, however, also conceivable to provide only one transportation roller 26 and to use a stationary peel-off element, which engages by way of corresponding fingers in the gaps between the disks of the transportation roller 26, in order to peel the strip 14 of from this roller.

The applied strip 14 or piece of strip 14*a* can be made from a single- or multi-layer paper and/or plastic film or from a metal, the material properties, thickness and width of which can be adapted to the purpose to be fulfilled. The strip 14 can be printed with information relating to the product assortment 11*a,b*. The strip 14 can also be provided with different types of information supports such as, for example, magnetic strips or wirelessly readable data storage systems (e.g. RFIDs). The strip 14 can also be color-coded. In the simplest case, the strip 14 is uncoated. However, at least one side of it may also be provided with an adhesive layer which then faces the advanced product assortment 11*a,b* during the application process. It is also conceivable to fiber-reinforce the strip 14 in order to make it particularly tear-resistant. The edges of the strip 14 can furthermore be provided with notches in order to make it easier to separate the applied piece of strip 14*a* later. Lastly, it is also conceivable not to cut the piece of strip 14*a* off from the strip 14 but to separate it in a different manner, for example by using a strip 14 that is transversely perforated at suitable points. Within the scope of the invention, it is also possible to use whole sheets instead of strip-like elements to enclose the product assortment.

Figure 5:
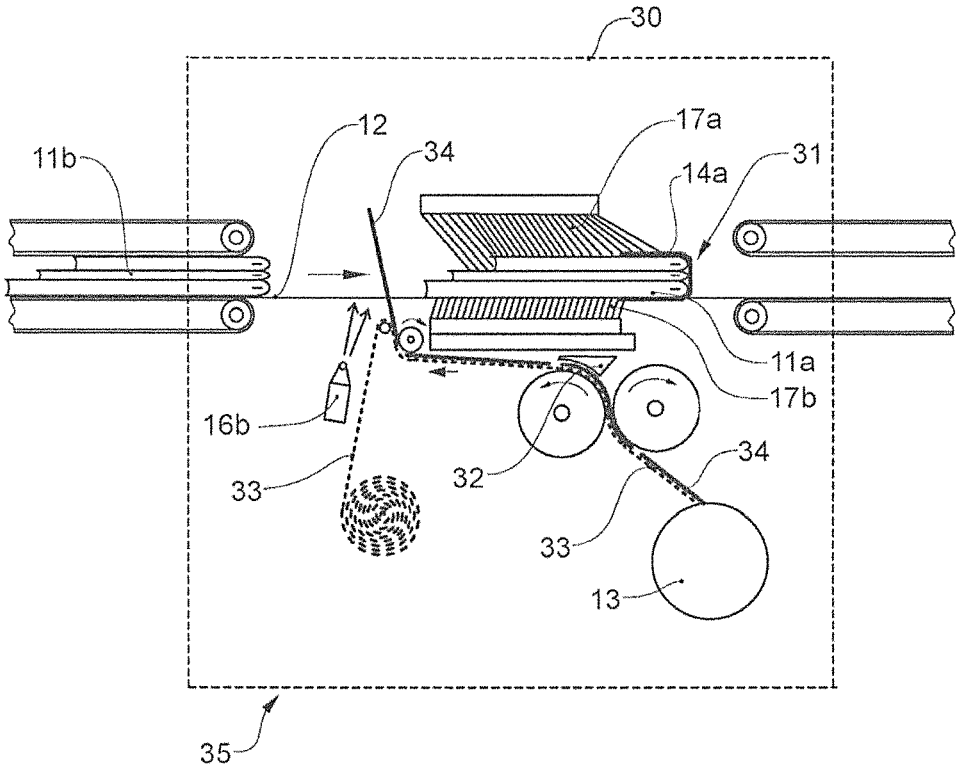
FIG. 5 shows a view similar to FIG. 4 of an application unit according to an exemplary embodiment of the invention in which individual elements, in particular labels, are removed from an advanced carrier tape and are provided so that they can be carried along.

FIG. 5 shows an individual element application device 35 that is similar to that in FIG. 4, in which the individual, in particular self-adhesive labels 34 or similar individual elements are advanced on a carrier tape 33. In the region of the air nozzle 16*b*, the carrier tape 33 is deflected sharply downward so that the individual elements 34 are removed or peeled off from the carrier tape 33 virtually automatically and placed in the transportation path of the product assortments 11*a,b* under the action of the air jet from the air nozzle 16*b*. After the labels or individual elements 34 have been removed, the empty carrier tape 33 can be wound up, as indicated in FIG. 5.

It goes without saying that the individual elements or labels 34 can be printed or otherwise provided with optical or electronic information (for example, in the form of bar codes or RFIDs) which can be delivered along with the respective product assortment to the end user or to the forwarding agent for the products.

Figure 5A:
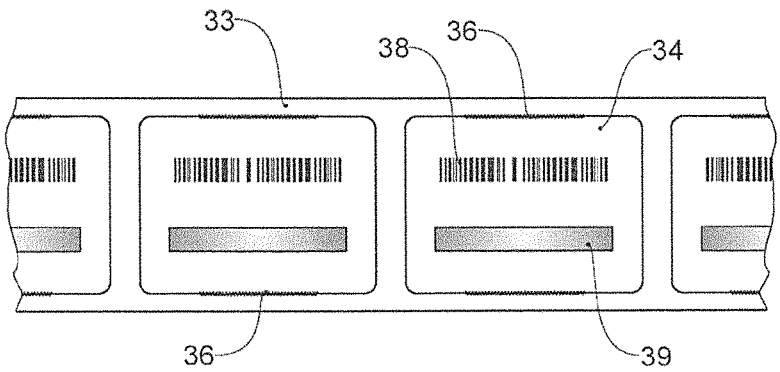
FIGS. 5A-B show a view from above of two exemplary embodiments for a carrier tape with labels.
Figure 5B:
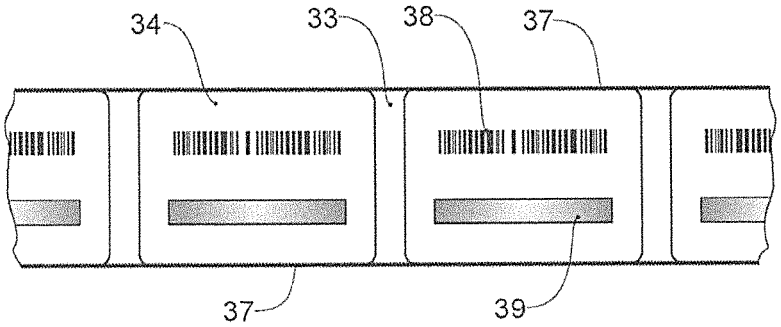

FIGS. 5A and 5B show a view from above of two exemplary embodiments for a carrier tape 33 carrying a label 34, wherein the individual labels 34 are printed or otherwise provided with a bar code 38, shown by way of example, and textual or pictorial information 39. In addition, weakening means, for example in the form of notches or teeth or the like, can be arranged on the labels 34, which make it easier to detach the labels 34 later in order to break up the product assortment held together by the labels 34. In the case of FIG. 5A, where the labels 34 are spaced apart from the edge of the carrier tape 33 widthwise, the weakening means 36 can be limited to edge regions of the labels 34. In the case of FIG. 5B, where the labels 34 and the carrier tape 33 have longitudinal edges situated directly above one another, the weakening means 37 can be designed so that it can run continuously along the edges of the carrier tape 33 and the labels 34, which greatly simplifies manufacture.

It goes without saying that such weakening means can also be used advantageously with a strip 14 according to FIG. 1.

It is claimed:

1. An enclosing element application device for performing a method for applying at least one enclosing element comprising an individual element made from paper, to a sheet-like product assortment comprising multiple products, including printed products or advertising material, comprising a transportation device for transporting the sheet-like product assortment that defines a transportation path running through an application unit, wherein the application unit is equipped with means for holding ready for use an enclosing element to be applied, comprising an individual element made from paper, at a predetermined point of the transportation path in a position where it crosses the transportation path, wherein stop means are provided, spaced apart on both sides of the transportation path, against which lies the enclosing element to be applied across the transportation path, and is supported in the direction of transportation in such a way that product assortments transported on the transportation path can be moved between the stop means, carrying enclosing elements along with them; and wherein the application unit is equipped with pressure means for pressing the carried-along enclosing element against side faces of a product assortment situated parallel to the transportation path, and arranged behind the stop means in the direction of transportation, wherein the pressure means comprise an upper pressure brush and a lower pressure brush arranged essentially parallel to each other and parallel to the transportation path extending parallel to the transportation path, one above the other at a distance such that the ends of their bristles meet at the level of the transportation path, and that a product assortment transported on the transportation path through the application unit can be moved through between the upper pressure brush and the lower pressure brush.

2. The enclosing element application device as claimed in claim 1, wherein the carried-along enclosing element is printed or is provided with an information carrier selected from the group consisting of magnetic strips and wirelessly readable data storage systems.

3. The enclosing element application device as claimed in claim 1, wherein the carried-along enclosing element is made from a single- or multi-layer paper.

4. The enclosing element application device as claimed in claim 1, wherein at least one side of the carried-along enclosing element is provided with an adhesive layer which faces an advanced product assortment during the application process.

5. The enclosing element application device as claimed in claim 1, wherein the upper pressure brush of the pressure means of the application unit has long, soft bristles that are bent when a product assortment passes through in the direction of movement and cling to the product assortment as it passes through.

6. The enclosing element application device as claimed in claim 1, wherein the lower pressure brush of the pressure means of the application unit has short, hard bristles, having ends which form a portion of the continuous transportation path.

7. The enclosing element application device as claimed in claim 1, wherein the upper pressure brush of the pressure means of the application unit has long, soft bristles that are bent when a product assortment passes through in the direction of movement and cling to the product assortment as it passes through, and the lower pressure brush of the pressure means of the application unit has short, hard bristles, having ends which form a portion of the continuous transportation path.

8. The enclosing element application device as claimed in claim 1, wherein the enclosing elements take a form of pieces of strip, and wherein the means for holding ready for use an enclosing element in the form of a piece of strip to be applied comprise means for holding a strip ready for use, comprising a feed unit with at least one driven roller against which the strip lies, and means for cutting off the piece of strip to be applied from the provided strip.

9. The enclosing element application device as claimed in claim 8, wherein the means for holding ready for use an enclosing element in the form of a piece of strip comprise a gas or air nozzle for aligning and applying the piece of strip against the stop means, said gas or air nozzle being able to generate a gas or air jet directed obliquely upward in the direction of transportation.

10. The enclosing element application device as claimed in claim 8, wherein the means for cutting off the piece of strip to be applied from the provided strip comprise a blade situated at a distance from and parallel to the transportation path and having a cutting edge pointing in the opposite direction to the direction of transportation.

11. The enclosing element application device as claimed in claim 10, wherein the means for holding ready for use an enclosing element in the form of a piece of strip comprise a gas or air nozzle for aligning and applying the piece of strip against the stop means, said gas or air nozzle being able to generate a gas or air jet directed obliquely upward in the direction of transportation.

12. The enclosing element application device as claimed in claim 1, wherein the enclosing elements take the form of individual elements, in particular self-adhesive labels, and wherein the means for holding ready for use an enclosing element in the form of an individual element to be applied comprise means for advancing a carrier tape provided with individual elements, and means for removing or peeling off the individual element to be applied from the carrier tape.

13. The enclosing element application device as claimed in claim 12, wherein the means for holding ready for use an enclosing element in the form of an individual element to be applied comprise a gas or air nozzle for aligning and applying the individual element against the stop means, said gas or air nozzle being able to generate a gas or air jet directed obliquely upward in the direction of transportation.

* * * * *